US006860115B2

(12) United States Patent
Norelius et al.

(10) Patent No.: US 6,860,115 B2
(45) Date of Patent: Mar. 1, 2005

(54) AIR-CARGO CONTAINER, A REFRIGERATOR UNIT FOR AN AIR-CARGO CONTAINER AND A MANUFACTURING METHOD OF AN AIR-CARGO CONTAINER

(75) Inventors: Stefan Norelius, Edsbro (SE); Goran Westerholm, Uppsala (SE); Thomas Westerholm, Alunda (SE)

(73) Assignee: Envirotainer Engineering AB, Knivsta (SE)

( * ) Notice: Subject to any disclaimer, the term of this patent is extended or adjusted under 35 U.S.C. 154(b) by 108 days.

(21) Appl. No.: 10/203,473

(22) PCT Filed: Feb. 2, 2001

(86) PCT No.: PCT/SE01/00197

§ 371 (c)(1),
(2), (4) Date: Dec. 16, 2002

(87) PCT Pub. No.: WO01/58788

PCT Pub. Date: Aug. 16, 2001

(65) Prior Publication Data

US 2003/0101742 A1 Jun. 5, 2003

(30) Foreign Application Priority Data

Feb. 11, 2000 (SE) ..... 0000442

(51) Int. Cl.[7] ..... F25D 3/12; F25D 17/04
(52) U.S. Cl. ..... 62/387; 62/407
(58) Field of Search ..... 62/387, 407, 298, 62/388, 417; 220/1.5, 592.02, 592.01, 592.05

(56) References Cited

U.S. PATENT DOCUMENTS

| | | | | |
|---|---|---|---|---|
| 2,738,654 A | * | 3/1956 | Elston et al. | 62/426 |
| 3,575,312 A | | 4/1971 | Luisada | |
| 3,889,486 A | | 6/1975 | Hinckley et al. | |
| 4,276,752 A | * | 7/1981 | Modler et al. | 62/166 |
| 6,016,664 A | | 1/2000 | Larsson et al. | |

FOREIGN PATENT DOCUMENTS

| | | |
|---|---|---|
| GB | 1 251 470 | 10/1971 |
| SE | 504 894 | 5/1997 |

* cited by examiner

*Primary Examiner*—Chen Wen Jiang
(74) *Attorney, Agent, or Firm*—Young & Thompson

(57) ABSTRACT

An air-cargo container is equipped with a modular refrigerating unit, which is attachable into the container shell in substantially one piece. Preferably, a control unit for the modular refrigerating unit is also provided as one single module. The refrigerating unit comprises the entire enclosure of an airflow path around an icebox, and is preferably mounted at a small distance from the wall and ceiling of the container. Simple positioning elements facilitate the actual positioning and mounting procedure. The refrigerating unit preferably comprises sealing flanges which during mounting by the positioning elements automatically are fitted into elements at the container wall. A manufacturing method is also disclosed, which comprises mounting of modular units into a shell of an air-cargo container. The mounting is preferably performed by using positioning elements, which guides the modular units into the proper positions.

20 Claims, 6 Drawing Sheets

AIR-CARGO CONTAINER, A REFRIGERATOR UNIT FOR AN AIR-CARGO CONTAINER AND A MANUFACTURING METHOD OF AN AIR-CARGO CONTAINER

TECHNICAL FIELD

The present invention relates generally to air-cargo containers or other ULD:s (Unit Load Devices), and in particular to temperature controlled air-cargo containers/ULD:s and the manufacturing thereof.

BACKGROUND

The amount of goods transported by airfreight has increased considerably during the last years. In particular, transport of temperature sensitive goods, such as food, drugs, electronic equipment etc. has become more important. In order to be able to control the temperature even during the flight, insulated containers with temperature regulating equipment have been developed. Since security regulations concerning airfreight puts severe limitations on which type of equipment to be used during the flight. Carbon dioxide ice, placed in an icebox, is typically used as refrigerating medium. The icebox cools down the surrounding air and by means of small battery-driven fan systems, the cold air may be distributed within the container compartment.

In the design of ULD:s in general, such as air-cargo containers, weight is one of the most important parameters. Thus, the manufacturing of containers according to the prior art aims to reduce the amount of used material as far as possible. The icebox, fan equipment, control equipment and screens for defining airflow paths are thus attached directly into position in the container. The mounting takes place piece by piece, and makes use of the container walls and ceiling to reduce the total weight.

When the carbon dioxide ice evaporate, carbon dioxide gas is produced. This gas has to escape from the icebox. Some goods transported in cooled containers will be damaged by carbon dioxide exposure, why the carbon dioxide gas has to escape directly to the exterior of the container, and the icebox is therefore normally placed in the close vicinity of one of the container walls. The icebox also has to be sealed off from the interior of the container. Such sealing is performed directly against the container walls to ensure that no leaks will appear.

One example of an air-cargo container is disclosed in the international patent application WO97/27128 of Frigotainer AB. In order to increase the temperature interaction between the icebox and the surrounding air, an airflow path is typically arranged around the icebox, normally by providing flow paths in contact with the icebox. The typical configuration is to mount the icebox at a distance from the wall and ceiling of the container, using the container shell as the outer constriction of the flow path. This increases the sealing problems even further.

Containers according to the prior art have a number of disadvantages. First, the mounting times are long, since the difficult and detailed attachment of the numerous details of the cooling equipment takes place in a ready container shell. The limited space within the container makes the work difficult, and the total volume of the container requires large available mounting areas. The detailed mounting also requires skilled personnel and often also special tools, which makes end mounting and maintenance difficult at other places than at the production plants.

The distribution of containers from the manufacturing plant to the customers normally takes place by airfreight.

Smaller numbers of empty containers may be fitted into free space in different transports, but there is no place available for larger amounts. Special freights then have to be arranged for the distribution of new empty containers, which increase the total cost.

There are also some minor technical problems with air-cargo containers according to prior art. The airflow path around the icebox is typically in direct contact with the container wall. The wall will thus be cooled at a section where the need of cooling is low, reducing the available cooling effect of the carbon dioxide ice. Furthermore, the cooling of the container wall and ceiling at this position may even cause condensation or ice build-up problems at the outside of the container.

Also, during periods, where no cooling of the container compartment is not necessary and any fans are shut off to stop the airflow around the icebox, there are problems with cold air flowing down from the icebox in the opposite direction than the intended one. In order to stop such back-streaming of cold air, the airflow path situated above the inlet and outlet openings of the airflow path may be thermally insulated in order not to produce any cold air. However, such insulation reduces the available heat exchange between the air and the icebox.

SUMMARY

An object of the present invention is to facilitate a simple mounting of air-cargo containers and other ULD:s, which is suitable both for remote end mounting and service purposes. Another further object of the present invention is to improve the heat exchange with the icebox and to use the cold air in a more efficient manner.

The above objects are achieved by devices and methods according to the present patent claims. In general words, an air-cargo container is equipped with a modular refrigerating unit, which is attachable into the container shell in one piece. Preferably, a control unit for the modular refrigerating unit is also provided as one single module. The refrigerating unit comprises the entire enclosure of an airflow path around an icebox, and is preferably mounted at a small distance from the wall and ceiling of the container. Simple positioning elements facilitates the actual positioning and mounting procedure. The refrigerating unit preferably comprises sealing flanges which during mounting by the positioning elements automatically are fitted into elements at the container wall. Back-streaming of cold air is prevented by letting a flexible sheet cover the inlet opening of the airflow path by the action of gravity.

According to another aspect of the invention, a manufacturing method is disclosed, which comprises mounting of modular units into a shell of an air-cargo container. The mounting is preferably performed by using positioning elements, which guides the modular units into the proper positions.

The present invention has a number of advantages. The modular mounting provides a possibility for remote end mounting of containers. This means that the containers may be distributed in relatively small compact packages and can be end mounted at the end user in a simple manner. Service is facilitated, since defect modules simply are exchanged for new ones, and the actual service will not stop the use of the rest of the container. Furthermore, the incorporation of the entire airflow path around the icebox into the refrigerating unit removes some of the previous sealing problems. By furthermore positioning the refrigerating unit properly, the heat transfer to/from the container wall is reduced.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
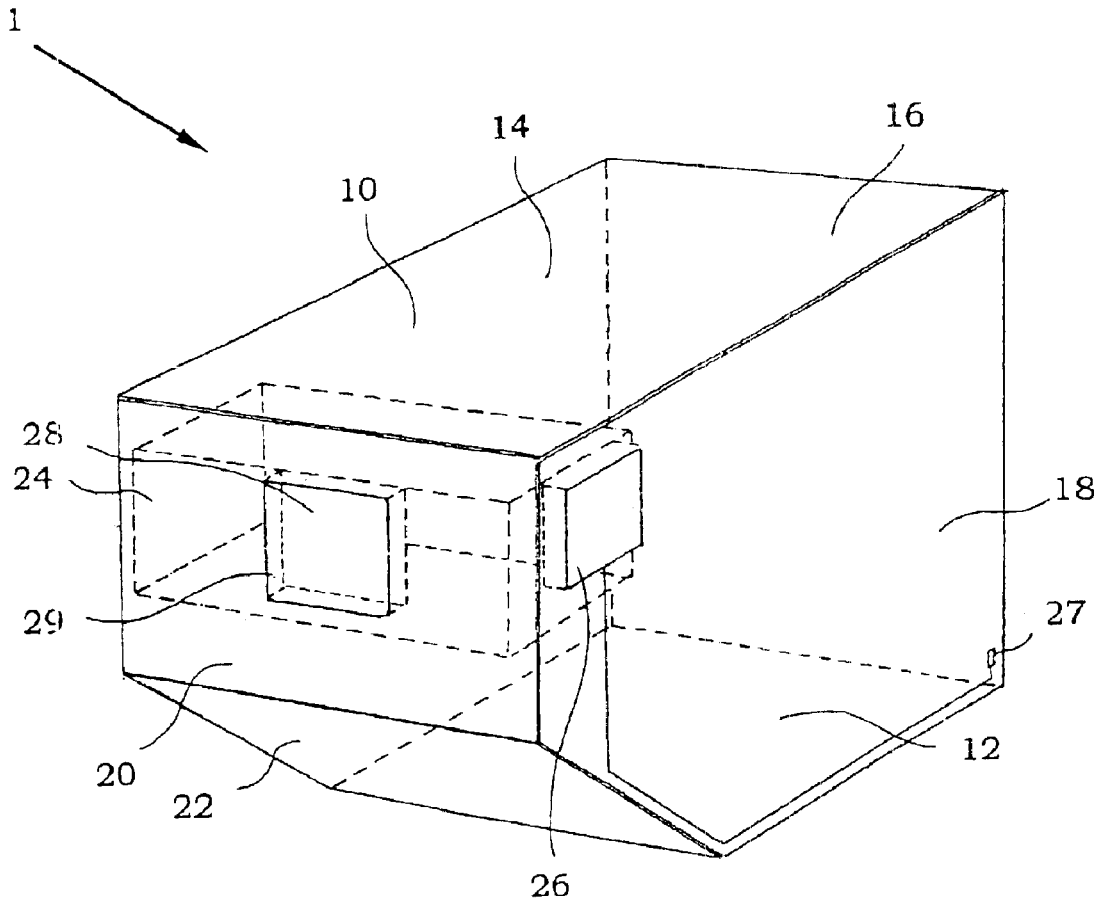
FIG. 1 is an embodiment of an air-cargo container according to the present invention.

According to the present invention, a temperature controlled air-cargo container is mounted in a modular fashion. A container shell is assembled, which comprises a floor, a ceiling and walls and composes the main structure of the air-cargo container. In order to provide temperature control, a refrigerating unit is provided, providing a stream of cooled air. A control unit, regulating the operation of the refrigerating unit is also provided. Preferably, an icebox lid unit is also provided. According to the present invention, the refrigerating unit and preferably also the control unit and icebox lid unit are provided as modular units, i.e. each of them is mounted in the container shell as one piece or module, including all its functions within this module. The respective module is attached to the container shell in the proper position by attachment means, which may be separate from the modules, and is electrically connected. Preferably, this attachment is performed in an easily detachable manner, in order to facilitate e.g. replacement of the module. The attachment means should therefor allow an easy removal of said modular unit as an integral whole.

The mounting of the refrigerating unit and possibly also the control unit as modules implies a number of advantages. The precision work of assembling the refrigerating unit can be performed at another place than the final assembling of the entire container. The refrigerating unit can also be assembled under much more comfortable conditions, than inside a container. The modules may be functionally tested in special test equipment before the final mounting into the container, instead of making the tests on the final container. This means that the time between when the empty container shell is provided and when a complete temperature controlled container is ready is remarkably reduced, which gives cost advantages. Furthermore, the final assembling may be performed by means of only simple tools, and by non-specialist workers. The container may even be transported to its delivery destination in pieces, and the container shell and the module mounting may be performed at the final destination. This reduces the transport costs significantly.

The modular assembling concept, together with the attachment means allowing for an easy removal, makes service operations very easy. Any defect modules or container shell parts may easily be replaced by new ones in a very short time, and the use of the container can be resumed. The damaged or defect part or module may then be repaired either at the field or sent to any service facility, or simply scraped. Also, by applying the assembling concept of the present invention, the container becomes easily collapsible. In other words, the container may be easily dismounted at one place, transported in a compact manner to another place, or simply stored in a compact manner, and finally re-assembled. This is a considerable advantage in cases where the amount of incoming and outgoing temperature sensitive goods is differing considerably, and where a pile-up or lack of container units may arise. A redistribution of "collapsed" containers is cheaper and easier than transportation of empty mounted containers.

The concept of manufacturing air-cargo containers in a modular way has not earlier been used, despite the fact that such containers have been available since decades. The advantages of module mounting are quite clear, once the idea is presented, but in the present technical field, this has not been an obvious step to make. The reason for this may partly depend on the fact that most air-cargo containers are fairly simple, and that there are no complicated assembling inside the container shell. In modern temperature controlled air-cargo containers, such as the one disclosed in the international patent application WO97/27128, the introduction of refrigerating equipment has increased the number of internal parts. However, even here, sealing problems and concerns about minimising the total weight have drawn the attention to other mounting principles.

By introducing a modular mounting of the refrigerating unit, some problems are accentuated. In a refrigerating unit, mounted piece by piece, the main sealing problem is the one prohibiting the carbon dioxide gas to penetrate into the container compartment in connection with the icebox lid. However, the individual pieces may easily be sealed against the container walls, providing a requested airflow path around the icebox. By introducing a modular refrigerating unit, such sealing has to be solved together with the attachment of the unit, or within the unit itself.

A preferred embodiment of the present invention will now be described in detail. In FIG. 1, an air-cargo container 1 is illustrated. The container 1 comprises a container shell, in this embodiment consisting of a ceiling 10, a floor 12, two end walls 16, 20 and two side walls 14, 18. One of the end walls 20 provided with a sloping portion 22, according to IATA ULD-standards. One of the side walls also provides an opening with doors (not shown), for access to the interior or compartment of the container 1. According to the present invention, a refrigerating unit 24 is provided as one single module. The refrigerating unit 24 is mounted in the container compartment in the vicinity of one of the end walls 20 and the ceiling 10. The refrigerating unit 24 is in this embodiment mounted at a small distance to the container shell, which will be described more in detail below. The refrigerating unit 24 comprises an icebox opening 28, through which carbon dioxide ice may be entered into the refrigerating unit 24. A corresponding opening 29 is provided in the end wall 20.

A control unit 26, for regulating the operation of the refrigerating unit 24 is also provided as a module, and is mounted at one of the side walls 18 in the vicinity of the refrigerating unit 24. The control unit 26 is electrically connected to the refrigerating unit 24. The control unit 26 is in the present embodiment powered by batteries (not shown). A temperature sensor 27 is mounted within the container compartment in order to provide the control unit 26 with information about the cooling situation in the container. The regulation of the refrigerating unit 24 operation is based on the sensor readings.

Figure 2:
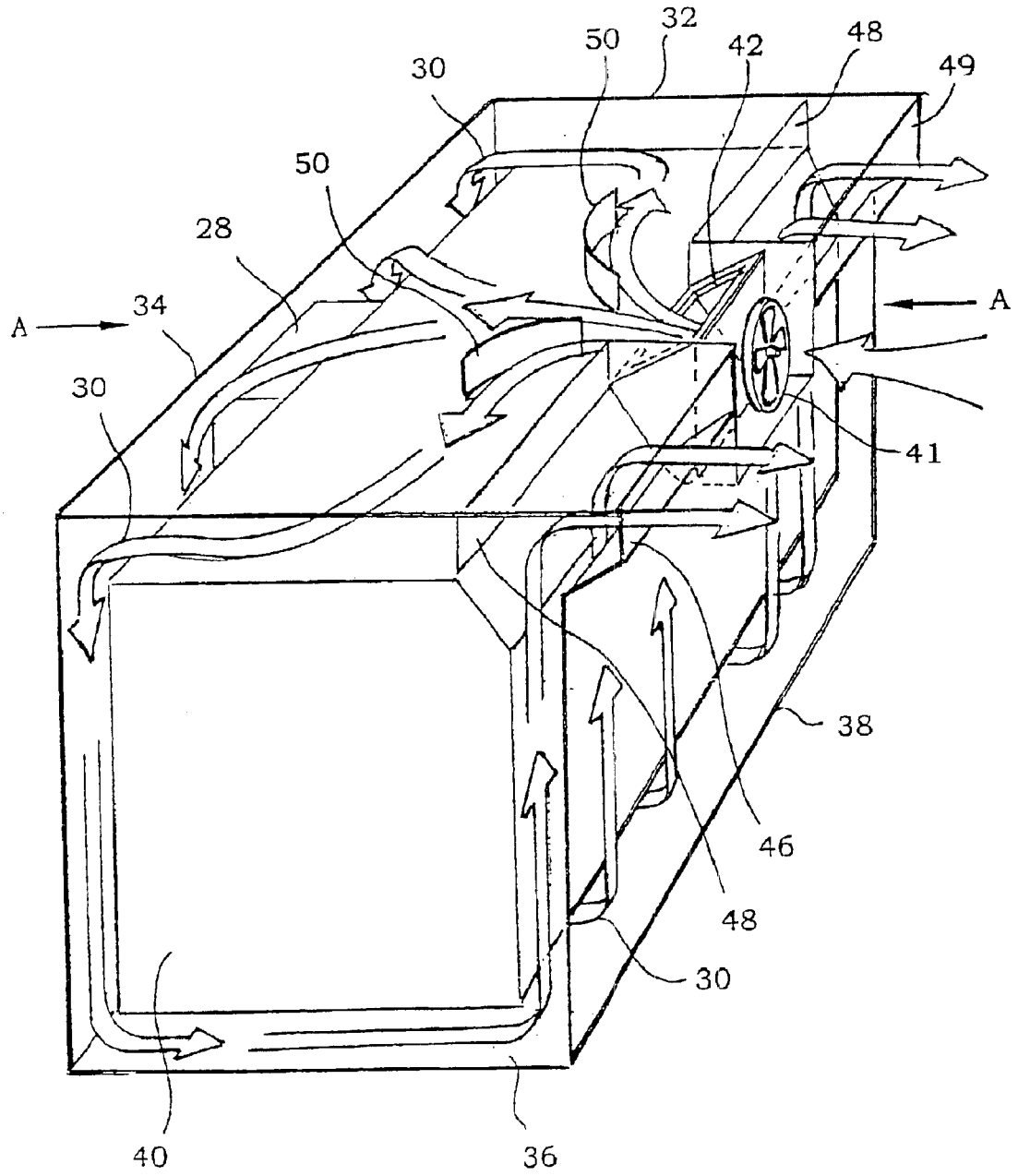
FIG. 2 is a perspective view of an embodiment of a refrigerating unit according to the present invention, illustrating an airflow path around an icebox.

FIG. 2 illustrates the refrigerating unit 24 in somewhat more detail. Some parts of the refrigerating unit 24 are remove in order to facilitate the understanding of the drawing. The refrigerating unit 24 comprises an icebox 40, in which carbon dioxide ice is going to be placed for serving as a cooling agent. In this embodiment, the refrigerating unit 24 comprises a totally covered airflow path around the icebox 40 entirely within the module, illustrated by the arrows 30 (of which only some has been supplied with reference numbers in order to simplify the illustration). This means that the interior airflow path is defined by enclosure means, such as a top plate 32, an outer side plate 34, a bottom plate 36 and an inner side plate 38. A closed airflow path removes the problems of sealing any airflow path against the container walls and ceiling.

The airflow through the airflow path starts through an inlet opening 42, which is described more in detail below. Two deflection plates 50 distribute the airflow partly to the sides. The airflow continues between the icebox 40 and the outer side plate 34 on each side of the icebox opening 28, and further below the icebox 40 and above the bottom plate 36. The flow continues up between the icebox 40 and the inner side plate 38 and out through two outlet openings 46, 49. The airflow is prohibited to reach the inlet region by constriction plates 48. The airflow path 30 thus encircles substantially the whole icebox 40, accomplishing a cooling down of the air.

Figure 3:
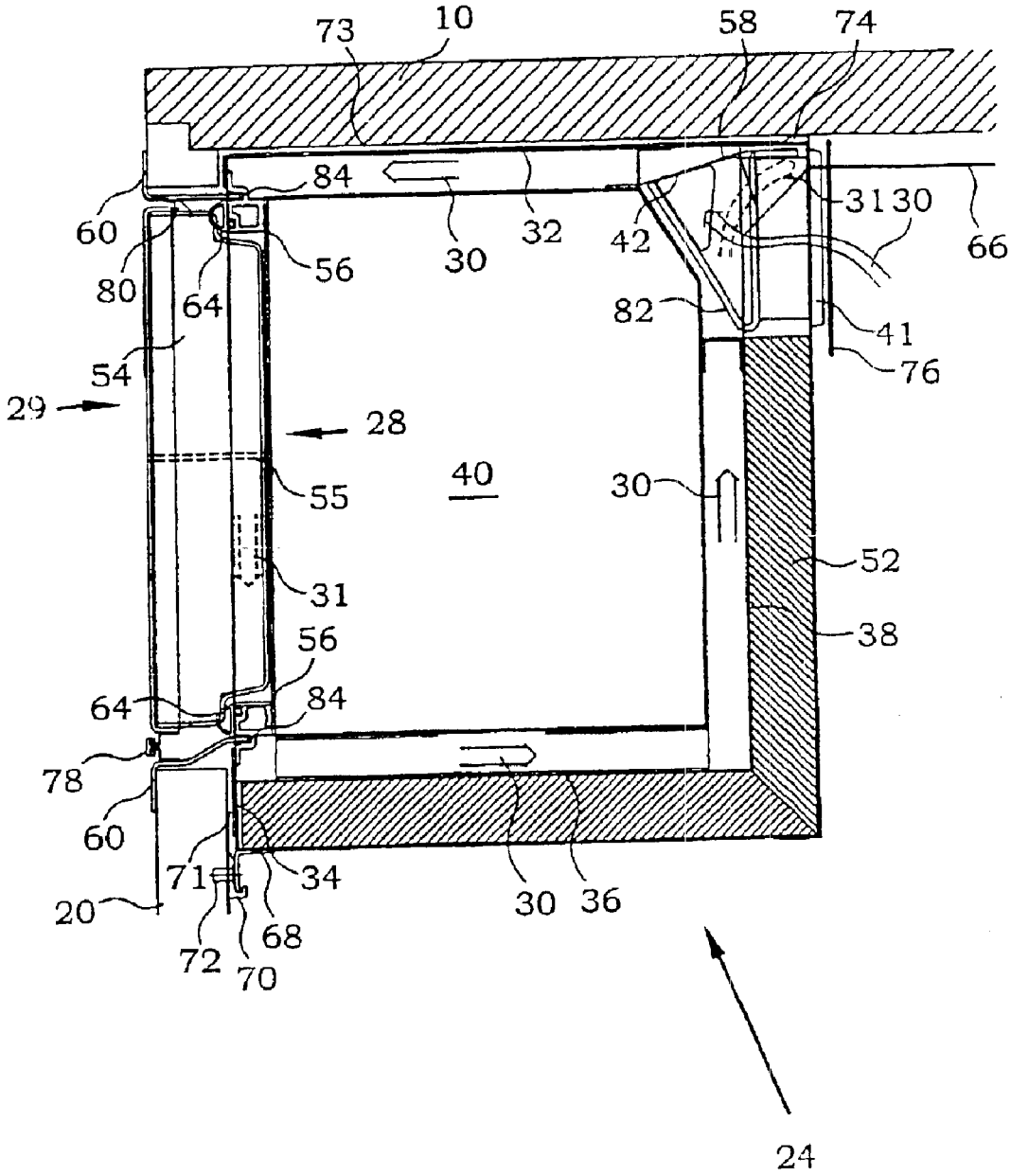
FIG. 3 is a cross-sectional view of a refrigerating unit according to the present invention mounted in an air-cargo container.

FIG. 3 illustrates a cross section if the refrigerating unit 24 along the arrows A—A in FIG. 2, when mounted in the container 1. The airflow path is also here easily distinguishable. The incoming air is drawn by a fan 41 through an inlet frame 82 and the inlet opening 42. The fan is protected from mechanical damage by a grid 76. A valve 58 (further discussed below) prohibits backstreaming of cooled air when the fan is not operating. The airflow continues around the icebox 40, and broken arrows 31 indicate a flow in front or behind the plane of the drawing. The plates 32, 34, 36 and 38 and the icebox 40 defines the airflow path around the icebox 40. The airflow exits through (not shown) outlet openings above distribution plates 66, arranged at the ceiling 10 of the container. The bottom plate 36 and the outer side plate 38 are formed by insulating panels, having an insulating layer 52, to reduce the heat transfer from the container compartment.

It should be noticed, that the enclosure of the airflow path in the vicinity of the container shell, i.e. the plates 32 and 34, are positioned at a small distance 73, 71 from the ceiling 10 and the end wall 20, respectively. This separation reduces the heat transfer between the refrigerating unit 24 and the container shell, which means that the cooling capacity of the carbon dioxide ice is used more efficiently. In order to facilitate an easy positioning of the refrigerating unit 24 relative to the container shell, positioning elements 68, 70, 74 are provided. These elements 68, 70, 74 will be further discussed below.

Around the icebox opening 28, a sealing profile 56 is provided. The profile 56 is attached to the edges of the icebox opening, and is in this embodiment provided with a cavity, directed towards the end wall 20. The cavity is filled with sealing material 84. A sealing flange 60 is arranged at the container end wall 20 pointing inwards to the icebox 40 through the end wall opening 29.

The sealing flange 60 has a protruding part, which is conformed with the cavity of the sealing profile 56. When the protruding part of the flange 60 is introduced into the cavity of the profile 56, a sealing is provided. This is described more in detail below.

An icebox lid 54 is attached by hinges 78 to the end wall 20. A sealing 64 seals off the interior of the icebox 40 from the volume outside the container. However, when an overpressure of carbon dioxide gas builds up within the icebox 40, the overpressure of the gas will escape through a hole 55 in the icebox lid 54. A hole may alternatively be provided in the profile 56. An alternative way is also to let the gas push away the sealing 64 in order to release some gas. The lid is locked by a latch 80.

Figure 4:
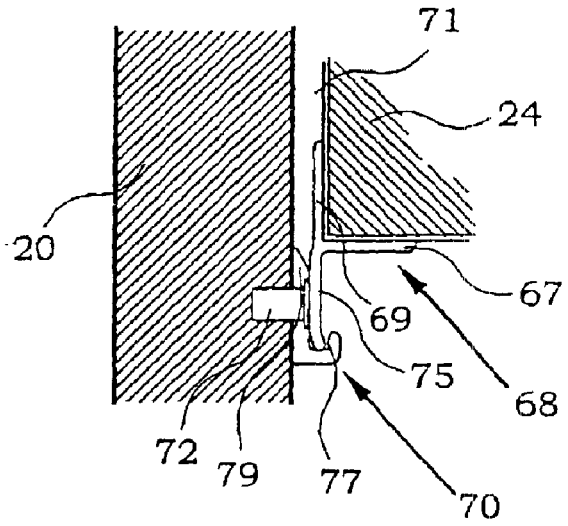
FIG. 4 is a detailed view of positioning elements for a preferred embodiment of the refrigerating unit.

FIG. 4 illustrates a detailed drawing of the positioning and attachment means between the container end wall 20 and the refrigerating unit 24. A profile element 68 is attached to the lower edge of the refrigerating unit 24. The profile element is shaped with two legs 67, 69 along the refrigerating unit outer walls and a portion 75 protruding outwards, substantially in a vertical direction. A profiled strip 70 is attached to the end wall 20 by attachment means, in this embodiment a screw 72. The profiled strip 70 forms a cavity 77, the opening of which is directed upwards. The profiled strip 70 also comprises a shoulder portion 79. The protruding portion 75 can be inserted into the cavity 77, and the refrigerating unit may be tilted around the tip of the protruding portion, until the side of the protruding portion 75 comes into contact with the shoulder portion 79. The profiled strip 70 prohibits the profile element 68 to be moved downwards along the end wall 20, and the shoulder portion 79 and the cavity 77 prohibits the profiled element 68 to be moved any significant distance perpendicular to the end wall 20, when the refrigerating unit 24 is tilted into a substantially horizontal position. The profiled strip 70 and the profile element 68 together defines the position of the refrigerating unit 24 relative to the end wall 20, in order to provide a suitable separation 71.

Figure 5:
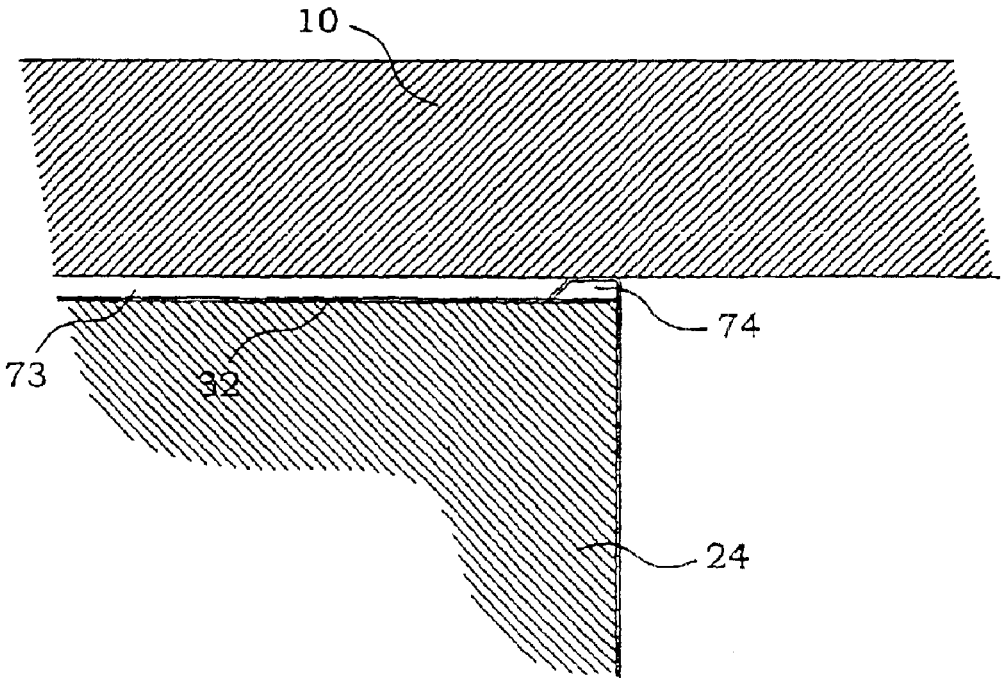
FIG. 5 is a detailed view of another positioning element for a preferred embodiment of the refrigerating unit.

FIG. 5 illustrates a detailed drawing of the positioning between the container ceiling 10 and the refrigerating unit 24. A shoulder element 74 is provided at the upper part of the refrigerating unit 24, in this embodiment in connection with the inlet opening, enclosing the airflow path. The width of the shoulder element 74 defines the distance between the upper plate 32 and the inner surface of the container ceiling 10.

When mounting the refrigerating unit 24, the refrigerating unit 24 is tilted somewhat and the profile element 68 is entered into the cavity 77 of the profiled strip 70. The whole refrigerating unit 24 is thereafter tilted back to a substantially horizontal position, until the shoulder element 74 comes into contact with the ceiling 10. The positioning elements 68, 70, 74 are easy to manufacture to give a positioning accuracy of the requested degree. The refrigerating unit 24 is thereafter fixed to the container shell, preferably by attaching angle plates (not shown) to the side walls of the container. The angle plates may preferably be fastened by a limited number of screws or rivets, which makes a dismounting relatively easy. By making the refrigerating unit 24 easy to remove, facilitates any replacement operations, which is important for providing a fast maintenance service. Other easily detachable attachment means according to known art may also be used.

As anyone skilled in the art understands, there are many possible variations and modifications of suitable positioning means. The profile element 68 may have a different profile, and the actual shape of the profiled strip 70 may also be altered, as long as they provide a possibility to tilt the profile element 68 around the tip of the protruding portion without having any possibility to be moved downwards along the end wall 20, i.e. providing a hinging relation. The profile element 68 may be extended along the entire length of the refrigerating unit edge, but may also be provided as shorter portions. The same reasoning is valid for the profiled strip 70. However, the mechanical strength of the attachment elements has to be designed for the expected forces during transportation and loading, why continuous strips and profiles are preferred.

Figure 8A:
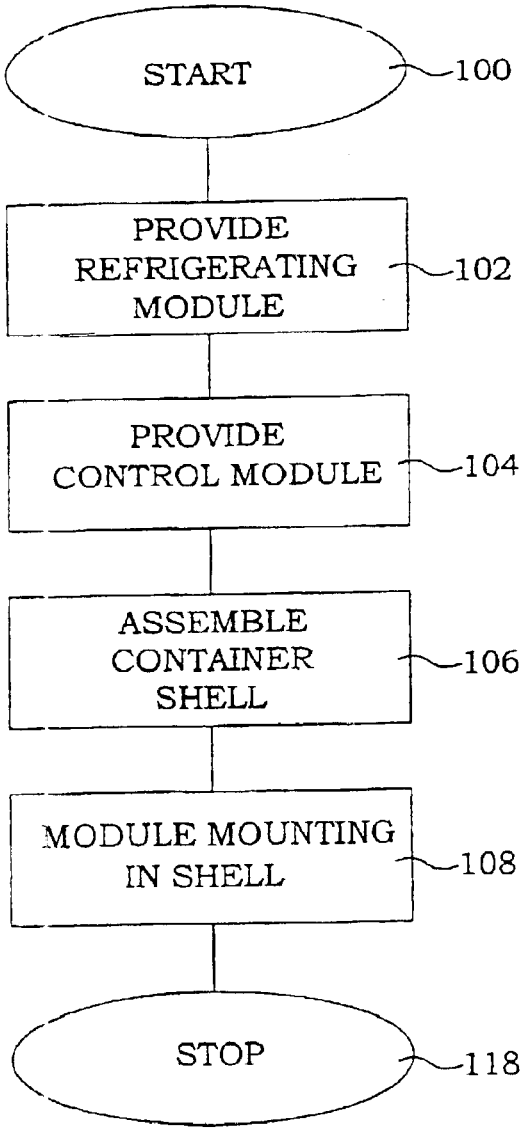
FIGS. 8*a* and 8*b* are flow diagrams illustrating manufacturing procedures according to preferred embodiments of the present invention.
Figure 8B:
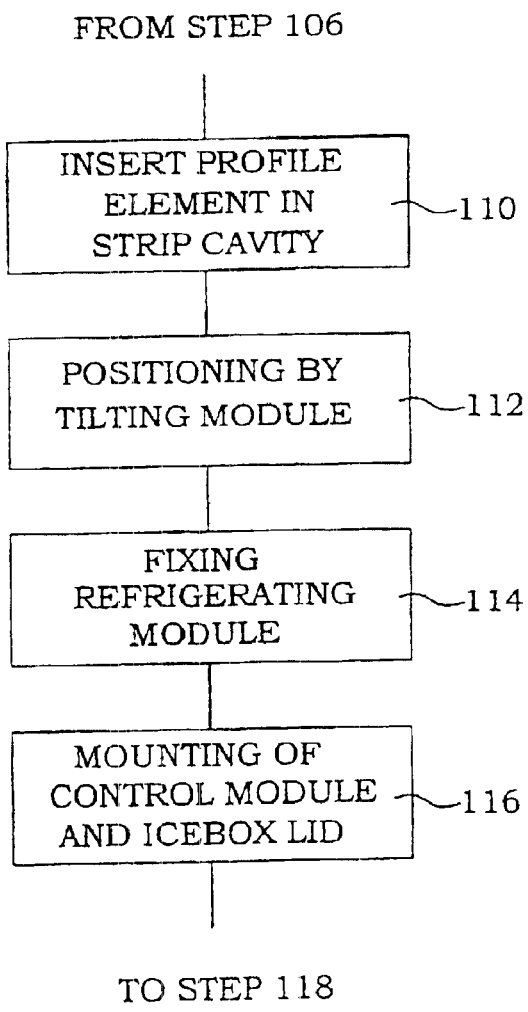

The mounting procedure is briefly described in FIGS. 8*a* and 8*b*. The manufacturing process starts in step 100. In step 102, a refrigerator unit is provided, by assembling the refrigerator unit in one module. The control unit is in a similar way assembled and provided in step 104. In step 106, the container shell, comprising e.g. floor, ceiling and walls, is assembled. In step 108, the modules are mounted into the container shell, before the process is completed in step 118.

FIG. 8*b* describes a preferred manner to accomplish the mounting step 108 in FIG. 8*a* in more detail. In step 110, a profile element of the refrigerating unit is inserted into a cavity of a profiled strip. The refrigerating unit is tilted into its required position in step 112, and is subsequently fixed against the container shell in step 114. In step 116, the control unit is mounted and connected to the refrigerating unit and the icebox lid unit is mounted. The procedure then continues to the step 118, where the manufacturing is ended.

Figure 6:
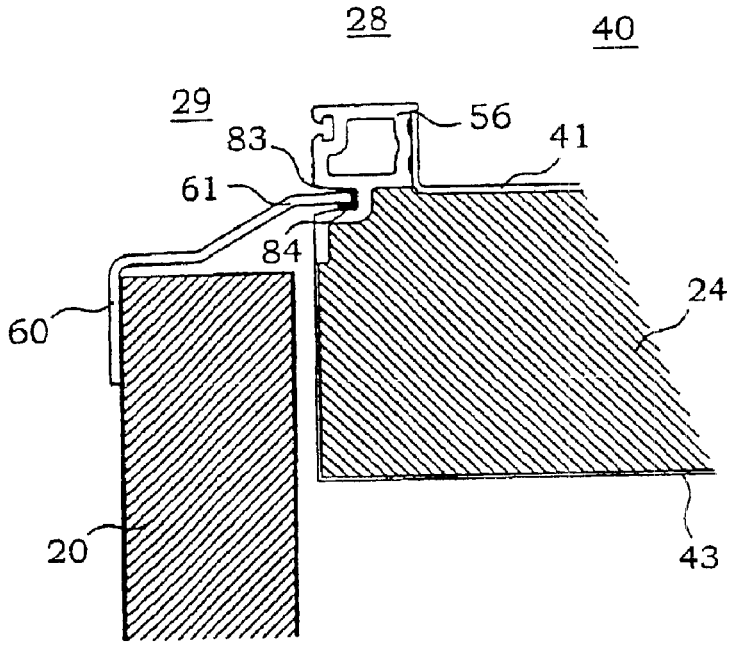
FIG. 6 is a detailed view of a sealing between the icebox and the wall of the container in a preferred embodiment of the present invention.

FIG. 6 illustrates a detail around sealing of the icebox opening. Some details, which are not of interest for this aspect, are removed from the illustration. The edge of the icebox opening 28 is covered with a plastic sealing profile element 56, which is attached to the enclosure 41 of the icebox 40 and to the outer part 43 of the refrigerating unit 24. The sealing profile element 56 is provided with a cavity 83, the opening of which is directed towards the end wall opening 29. The cavity 83 is partly filled with a sealing material 84, preferably either glue or silicon. The opening 29 in the end wall 20 is surrounded by another sealing profile, in this case a flanged plate 60. The inner part of the flanged plate is a protruding flange 61, protruding inwards to the interior of the container. The protruding flange 61 has the same shape as the cavity 83 of the profile 56, i.e. is conformed with the cavity. The protruding flange 61 has a length, which is adjusted to reach almost to the bottom of the cavity 83 when the refrigerating unit 24 and the protruding flange 61 are positioned in their final positions. Since the cavity 83 has a slightly wider opening than bottom, the protruding flange 61 will be guided into the cavity upon mounting. The width and depth of the cavity 83 allows for accommodate construction tolerances in three dimensions of the different parts. Preferably, the refrigerating unit is first tilted into its final position, the cavity 83 is filled with the sealing material 84, and the icebox lid 54 is thereafter fitted into its position, thereby forming a sealing by interaction with the sealing material 84 and the cavity 83. This sealing efficiently prohibits the carbon dioxide gas to penetrate into the container compartment.

Different variations and modifications are possible. The cavity part of the sealing, with the sealing material can be provided at the end wall 20 instead, and the icebox opening may then be provided with a protruding flange. Other shapes may also be possible, as long as they are conformed in the plane of the openings, and that one part of one of the sealing flanges is possible to fit into a generally cavity shaped part of the other one.

Figure 7A:
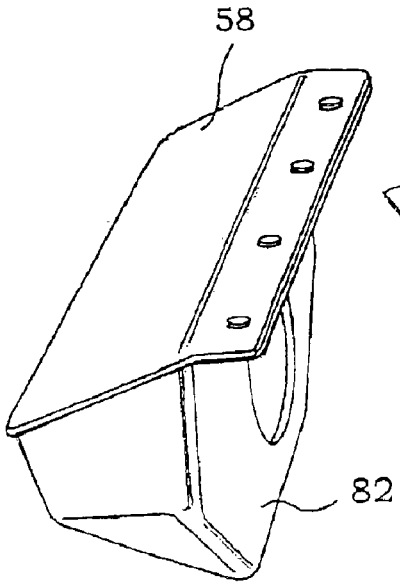
FIGS. 7*a* and 7*b* illustrates the inlet portion of a preferred embodiment of the refrigerating unit without and with an inwards directed air flow, respectively.
Figure 7B:
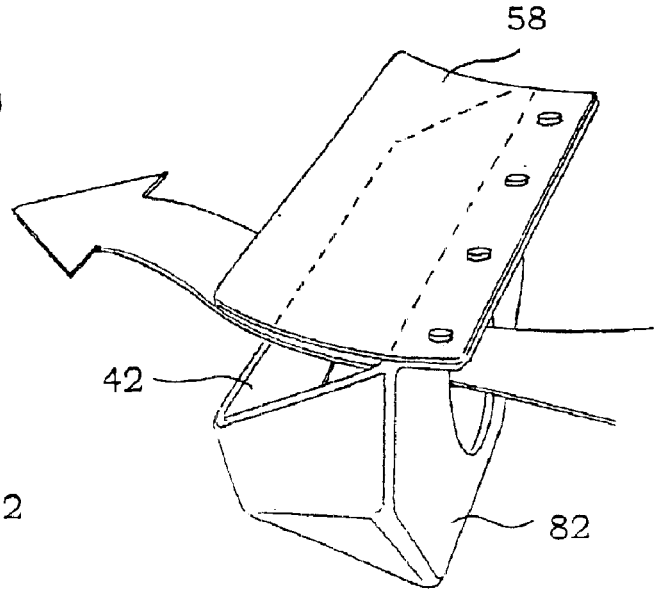

In the preferred embodiment, the refrigerating unit 24 is also provide with a valve prohibiting backstreaming of cold air, when the fan in inactive. FIGS. 7*a* and 7*b* illustrates the inlet frame 82 in a situation where it is inactive and where the fan blows air into the refrigerating unit, respectively. The inlet frame 82 defines a flow path of the incoming air, and the air enters into the actual enclosed airflow path through the inlet opening 42. The inlet opening 42 is directed somewhat upwards. When the fan is shut off, a sheet 58 of a flexible material, such as rubber or plastics, covers the inlet opening. The sheet 58 is thereby held against the opening 42 by means of gravitational forces, such as illustrated in FIG. 7*a*. When the fan is active and blows air into the airflow path, the sheet 58 is bent and uncovers the opening 42, whereby the air may enter into the airflow path.

It will be understood by those skilled in the art that various modifications and changes may be made to the present invention without departure from the scope thereof, which is defined by the appended claims.

What is claimed is:

1. An air-cargo container or other unit load device, comprising:

a container shell, having a floor, ceiling, side walls and end walls;

a first end wall of said end walls being provided with a wall opening;

a refrigerator unit, having an ice box and providing cooled air to the interior of said container shell, said refrigerator unit being attached against said first end wall and said ceiling said refrigerator unit being provided as a modular unit;

said refrigerator unit comprising an ice box opening for access to the interior of said ice box, said ice box opening facing said first end wall and being in alignment with said wall opening;

a control unit, controlling said refrigerator unit; and an icebox lid unit, provided at said first end wall in alignment with said wall opening;

said refrigerator unit comprises an enclosure, defining an interior air flow path surrounding said ice box;

said interior air flow path having a section between said ice box and said first end wall.

2. The air-cargo container according to claim 1, characterised by attachment means, allowing an easy removal of said modular unit in one piece.

3. The air-cargo container according to claim 1, characterised by positioning elements, separating said enclosure from said container shell by a distance.

4. The air-cargo container according to claim 3, characterised in that at least a first of said positioning elements is a profile element protruding outwards in the vicinity of a lower edge of said refrigerator unit facing said first end wall, and at least a second of said positioning elements is a profiled strip attached substantially horizontally at said first end wall, said profiled strip forming a cavity with an upwards directed opening, in which the protruding part of said profile element can be rotatably positioned, whereby said profiled strip prohibits motion of said profile element downwards along said first end wall.

5. The air-cargo container according to claim 4, characterised in that at least a third of said positioning elements is a shoulder element attached on the upper part of said refrigerator unit, facing a ceiling of said container shell, said shoulder element defining the distance between said refrigerator unit and said container ceiling.

6. The air-cargo container according to claim 1, characterised in that said interior air flow path has an inlet opening, directed substantially upwards, said inlet opening is provided with a back stream valve formed by a sheet of a flexible material covering said inlet opening, whereby the gravity force keeps said inlet opening closed, when no inwards directed flow is present through the inlet opening.

7. The air-cargo container according to claim 1, wherein said refrigerator unit further comprises a sealing profile encircling said ice box opening, wherein said first end wall is provided with a sealing profile encircling said wall opening, conformed with the sealing profile of said refrigerator unit, a first one of said sealing profiles exhibits a protruding flange in a direction of a second one of said sealing profiles, and wherein said second one of said sealing profiles exhibits a cavity, conformed with said protruding flange and filled with sealing material, whereby said protruding flange protrudes into said cavity in contact with said sealing material, forming a sealing.

8. A refrigerator unit for an air-cargo container or other unit load device, said refrigerator unit comprising:

an ice box;

an ice box opening at a first side of said ice box for access to an interior of said ice box;

means for providing cooled air into the surroundings;

said means for providing cooled air in turn comprising an enclosure, defining an interior air flow path, surrounding said ice box;

said interior air flow path having a section covering at least a part of said first side of said ice box;

said refrigerator unit being provided as a modular unit.

9. The refrigerator unit to claim 8, characterised by attachment means, allowing an easy removal of said modular unit in one piece.

10. The refrigerator unit according to claim 8, characterised by positioning elements, separating said enclosure from adjacent surfaces by a distance.

11. The refrigerator unit according to claim 10, characterised in that at least a first of said positioning elements is a profile element protruding outwards in the vicinity of a lower edge of said refrigerator unit.

12. The refrigerator unit according to claim 11, characterised in that at least a second of said positioning elements is a shoulder element attached on the upper part of said refrigerator unit, facing upwards, said shoulder element defining the distance between said refrigerator unit and any surface above.

13. The refrigerator unit according to claim 8, characterised in that said interior air flow path has an inlet opening, directed substantially upwards, said inlet opening is provided with a back stream valve formed by a sheet of a flexible material covering said inlet opening, whereby the gravity force keeps said inlet opening closed, when no inwards directed flow is present through the inlet opening.

14. The refrigerator unit according to claim 8, further comprising a sealing profile encircling said ice box opening, said sealing profile exhibiting a protruding flange directed outwards from said refrigerator unit.

15. The refrigerator unit according to claim 8, further comprising a sealing profile encircling said ice box opening, said sealing profile exhibiting a cavity filled with sealing material.

16. Manufacturing method of an air-cargo container or other unit load device, comprising the steps of:

assembling a container shell, having a floor, ceiling, side walls and end walls;

providing a wall opening in a first end wall of said end walls; and providing a modular refrigerator unit, having an ice box and an ice box opening for access to the interior of said ice box, in turn comprising the steps of:

providing said modular refrigerator unit with an enclosure defining an interior air flow path surrounding said ice box;

attaching said modular refrigerator unit to said first end wall, so that said ice box opening is in alignment with said wall opening, and a section of said interior air flow path being situated between said ice box and said first end wall;

positioning said modular refrigerator unit with a distance between said enclosure and said container shell; and fixing said modular refrigerator unit to said container shell, said manufacturing method comprising the further steps of:

providing an ice-box lid unit in alignment with said wall opening; and providing a control unit, controlling said refrigerator unit.

17. The manufacturing method according to claim 16, characterised in that said step of providing a control unit comprises the step of attaching a modular control unit to a wall of said container shell.

18. The manufacturing method according to claim 16, characterised in that said step of positioning in turn comprises the step of:

inserting a profile element, attached in the vicinity of a lower edge of said refrigerator unit and protruding outwards from said refrigerator unit, into a cavity, form by a profile strip attached substantially horizontally at said first end wall, and tilting said refrigerator unit around said profile element into the requested position.

19. The manufacturing method according to claim 18, characterised in that said step of tilting comprises tilting of said refrigerator unit until a shoulder element attached on the upper part of said refrigerator unit comes into mechanical contact with the said container ceiling.

20. The manufacturing method according to claim 16, wherein said step of providing a modular refrigerator unit comprises the further steps of:

providing said modular refrigerator unit with a sealing profile encircling said ice box opening, providing said first end wall with a sealing profile encircling said wall opening, conformed with the sealing profile of said modular refrigerator unit, filling sealing material into a cavity in one of said sealing profiles, and inserting said sealing profiles into each other, so that said sealing material forms a sealing.

* * * * *